US008807272B2

(12) United States Patent
Bladen

(10) Patent No.: US 8,807,272 B2
(45) Date of Patent: Aug. 19, 2014

(54) SOUND SUPPRESSOR FOR FIREARMS

(76) Inventor: John William Bladen, Weston (AU)

( * ) Notice: Subject to any disclaimer, the term of this patent is extended or adjusted under 35 U.S.C. 154(b) by 0 days.

(21) Appl. No.: 13/877,992

(22) PCT Filed: Oct. 5, 2011

(86) PCT No.: PCT/AU2011/001276
§ 371 (c)(1),
(2), (4) Date: Jun. 12, 2013

(87) PCT Pub. No.: WO2012/045119
PCT Pub. Date: Apr. 12, 2012

(65) Prior Publication Data

US 2013/0319790 A1 Dec. 5, 2013

(30) Foreign Application Priority Data

Oct. 5, 2010 (AU) ..... 2010904459

(51) Int. Cl.
*F41A 21/30* (2006.01)
*F41A 21/00* (2006.01)

(52) U.S. Cl.
CPC ..... *F41A 21/30* (2013.01)
USPC ..... 181/223; 89/14.4; 89/14.3

(58) Field of Classification Search
CPC ..... F41A 21/00; F41A 21/30; F41A 21/325
USPC ..... 181/223, 249, 248; 42/1.06; 89/14.4, 89/14.3, 14.2
See application file for complete search history.

(56) References Cited

U.S. PATENT DOCUMENTS 1,017,003 A 2/1912 Kenney
1,401,667 A * 12/1921 Brown ..... 89/137
1,482,805 A 2/1924 Maxim
(Continued)

FOREIGN PATENT DOCUMENTS

DE 19824730 A1 12/1999
GB 241526 A 4/1926
WO WO 8903958 A1 * 5/1989 ..... F41A 21/30

OTHER PUBLICATIONS

International Search Report and Written Opinion for PCT/AU2011/001276, mailed Nov. 10, 2011; ISA/AU.

(Continued)

*Primary Examiner* — Edgardo San Martin
(74) *Attorney, Agent, or Firm* — Harness, Dickey & Pierce, P.L.C.

(57) ABSTRACT

A sound suppressor for firearms (such as hand guns and rifles) has a tubular body with a first end cap adjacent the barrel of the firearm, and a 5 second end cap with exhaust vents for the gases. A plurality of baffles, each having a passage for the bullet, are provided in the body intermediate the first-and-second end caps. Each baffle has a plurality of vents in the outer portion, the vents forming at least one path for the flow of the major portion of the gases through the suppressor body. By angularly offsetting the vents of adjacent baffles, the gas path(s) are made tortuous to further slow the gas flow. The baffle adjacent the first end cap can be a deflecting baffle, where the vents deflect the gases outwardly towards the body. The body may be connected to the barrel of the firearm by screw-threads or a bayonet coupling; and a flash eliminator may be connected to the body adjacent the second end cap.

20 Claims, 10 Drawing Sheets

(56) References Cited

U.S. PATENT DOCUMENTS

| | | | | | |
|---|---|---|---|---|---|
| 2,101,848 | A | * | 12/1937 | Green | 89/14.5 |
| 2,442,773 | A | * | 6/1948 | Mason | 181/223 |
| 3,710,679 | A | * | 1/1973 | Werbell, III | 89/14.4 |
| 3,748,956 | A | | 7/1973 | Hubner | |
| 4,576,083 | A | * | 3/1986 | Seberger, Jr. | 89/14.4 |
| 4,588,043 | A | * | 5/1986 | Finn | 181/223 |
| 4,907,488 | A | | 3/1990 | Seberger | |
| 5,679,916 | A | * | 10/1997 | Weichert | 89/14.4 |
| 6,374,718 | B1 | * | 4/2002 | Rescigno et al. | 89/14.4 |
| 6,575,074 | B1 | | 6/2003 | Gaddini | |
| 7,308,967 | B1 | * | 12/2007 | Hoel | 181/223 |
| 7,594,464 | B2 | * | 9/2009 | Dueck | 89/14.4 |
| 7,610,992 | B2 | * | 11/2009 | Brittingham | 181/223 |
| 7,789,008 | B2 | * | 9/2010 | Petersen | 89/14.4 |
| 7,832,323 | B1 | * | 11/2010 | Davies | 89/14.4 |
| 8,087,338 | B1 | * | 1/2012 | Hines | 89/14.4 |
| 8,100,224 | B1 | * | 1/2012 | Olson | 181/223 |
| 8,167,084 | B1 | * | 5/2012 | Moore | 181/223 |
| 8,511,425 | B2 | * | 8/2013 | Larue | 181/223 |
| 2012/0180624 | A1 | * | 7/2012 | Troy et al. | 89/14.4 |

OTHER PUBLICATIONS

International Preliminary Report on Patentability for PCT/AU2011/001276, mailed Oct. 30, 2012; IPEA/AU.

* cited by examiner

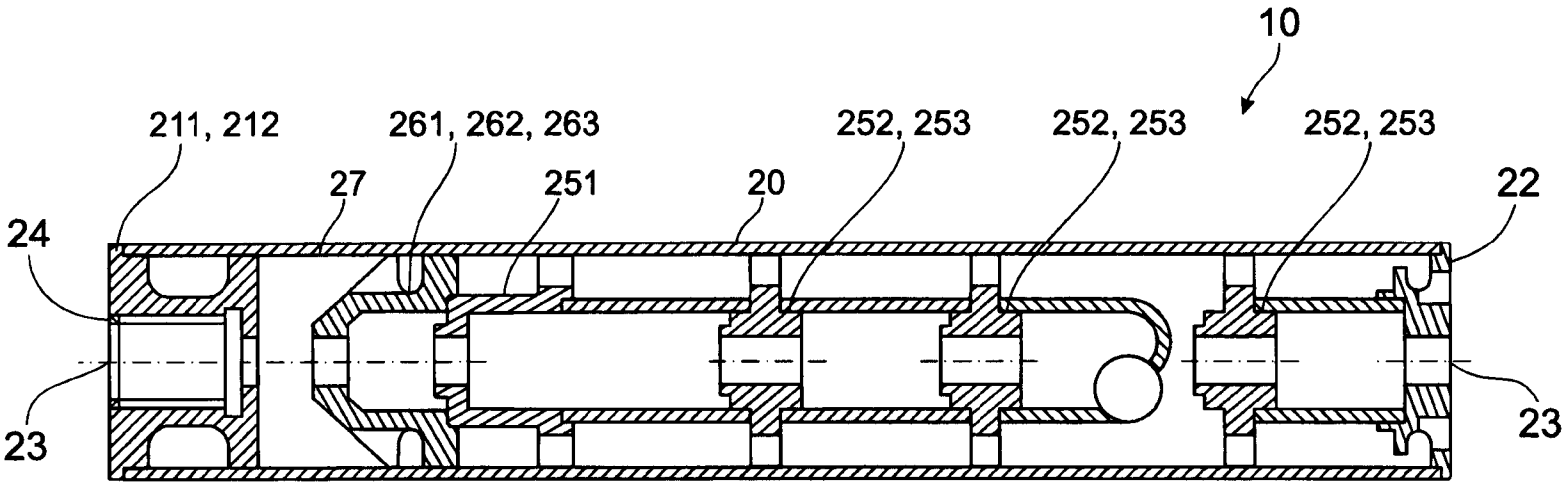
FIG. 2A
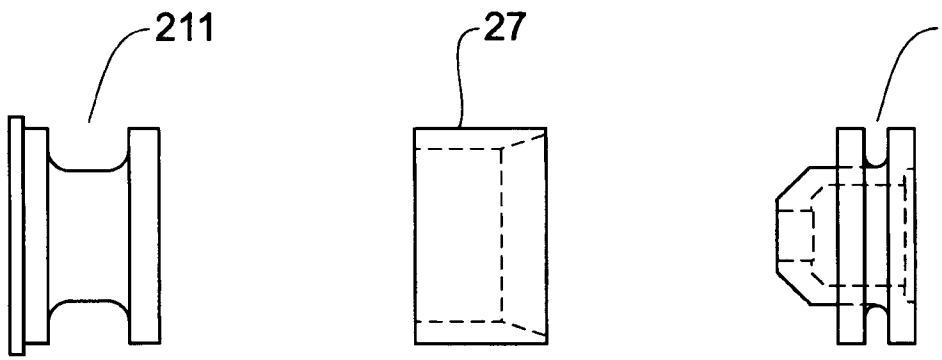
FIG. 2D
FIG. 2C
FIG. 2B

SOUND SUPPRESSOR FOR FIREARMS

CROSS-REFERENCE TO RELATED APPLICATIONS

This application is a 371 U.S. National Stage of International Application No. PCT/AU2011/001276, filed on Oct. 5, 2011, which claims priority to Australian Patent Application No. 2010904459, filed Oct. 5, 2010, the contents of which are hereby incorporated by reference in their entirety as if fully set forth herein.

FIELD OF THE INVENTION

This invention relates to sound suppressors for firearms. The term "firearms" includes hand guns (including revolvers and pistols), long guns (including rifles and shotguns), automatic weapons (including machine guns, submachine guns and automatic rifles), and air-operated firearms.

BACKGROUND OF THE INVENTION

Sound energy is produced when the propellant in a cartridge is ignited to force the bullet down the muzzle of a firearm. Suppressors (also known as silencers) for firearms operate by converting the majority of this sound energy to heat energy by diverting or trapping the pressurized gas in chambers within the suppressor body. The pressurised gas is forced to expand into the spaces within the suppressor, thereby decreasing the pressure, velocity and temperature of the gases prior to their release into the atmosphere.

A major advantage of using a sound suppressor is hearing protection for the firearm user and bystanders. In addition, the use of a sound suppressor helps to conceal the location of a firearm, which may be useful in military, police, sporting, hunting, and/or shooting situations. The delayed-release of the propellant gases may also reduce the recoil of the firearm and even increase the precision of a rifle.

U.S. Pat. No. 1,482,805 (Maxim), U.S. Pat. No. 3,748,956 (Hubner), U.S. Pat. No. 4,907,488 (Seberger), and U.S. Pat. No. 6,575,074 (Gaddini), and German Patent Number 19824730 (Joniskeit) provide examples of sound suppressors having a plurality of baffles with aligned openings for the passage of a bullet and propellant gases.

In Maxim, the baffles comprise a cylindrical rim of similar diameter to the outer body, wherein the edges opposite the bullet passageway are inclined to the axis of the outer body, thereby slowing the gases by directing them to adjacent baffles at an angle to the passage for the bullet.

In Hubner, the edges of the baffles comprise notches or serrations which are bent towards the muzzle of the firearm in order to disrupt the flow of gases. Hubner also discloses a return flow chamber adjacent to the entrance opening.

Seberger discloses a suppressor having a series of semi-spherical baffles with a plurality of holes in the circumference, wherein the holes in each adjacent baffle are aligned. In Seberger, each baffle is separated by a hollow cylindrical spacer wherein the diameter of the spacers is equal to that of the baffles.

Gaddini discloses a sound suppressor having a front end cap, at least one baffle element, and a rear end cap. The baffle element has an entrance aperture and an exit aperture. A spacer element, having at least one gas port and at least one notch, is positioned between the rear end cap and the baffle element. Expansion chambers are formed between the baffle element, the coaxial spacer and the front end cap. Once the firearm is discharged, the projectile gases pass through the rear end cap and flow forward and expand into the expansion chambers. The gases flow through the aperture of the baffle element and vent through the gas port in the spacer element, thereby creating an additional gas path. After moving through the gas paths in the suppressor, the gases are released via an aperture in the front end cap.

In Joniskeit, gases pass into expansion chambers and through a series of cross walls. The cross walls have gas holes which are offset from each other, thereby forming a tortuous path for the gases. After moving through the tortuous gas path in the suppressor (silencer), the gases are released via a gas outlet at the front of the suppressor.

OBJECT OF THE INVENTION

It is an object of the present invention to provide a sound suppressor for a firearm of substantially increased efficiency, which is particularly suitable for firearms of small calibre and/or with relatively high muzzle velocities.

It is a preferred object of the present invention to provide a sound suppressor which effectively diverts the flow of a large proportion of propellant gases, thereby decreasing the pressure and velocity of the gases prior to their release into the atmosphere.

SUMMARY OF THE INVENTION

In one aspect, the present invention resides in a sound suppressor for a firearm, including:

- a body;
- a first end cap in the body having an aperture for the passage of a bullet and an attachment mechanism for releasably mounting the suppressor to the firearm;
- a second end cap in the body, distal to the first end cap, having an aperture for the passage of a bullet, a plurality of inwardly extending channels for the entrance of gases, and a plurality of exhaust vents in an outer portion to allow the gases to be released from the suppressor; and
- a plurality of baffles in the body, between the first end cap and the second end cap, the baffles having an aperture for the passage of a bullet and a plurality of vents in an outer portion, wherein:
- the vents of the adjacent baffles form at least one passage for the gases; and
- a major portion of the gases pass through the at least one passage from the first end cap to the second end cap, while a minor portion of the gases pass through the apertures in the baffles.

Preferably, the vents of the adjacent baffles are angularly offset so that the at least one passage for the gases is a tortuous passage.

Preferably, the attachment mechanism is a thread for screw-attachment between the suppressor and the firearm. However, persons skilled in the field will appreciate that other forms of attachment mechanisms, such as bayonet couplings and clips, would also be suitable.

In an alternative embodiment, the outer body extends rearwardly from the first end cap over a portion of a barrel of the firearm, which is particularly suitable for use with longer firearms, for example rifles.

The body of the sound suppressor is preferably substantially cylindrical, square, pentagonal, hexagonal, or octagonal, in external shape.

The sound suppressor may further comprise a deflecting baffle adjacent to the first end cap, the deflecting baffle having an aperture for the passage of a bullet and a plurality of vents in an outer portion to direct the gases towards the body.

Preferably, the deflecting baffle is of a substantially truncated conical shape to direct outward expansion of the gases in a forward direction. In alternative embodiments, the deflecting baffle may be substantially annular or may have an intermediate portion which is a truncated cone shape with a concave profile.

In one preferred arrangement, at least one of the baffles has a single piece body incorporating a gas deflector, a crown, an outer portion with a plurality of vents, and respective male and female connectors at the ends.

At least one of the baffles could also have a body which is manufactured from separate pieces, wherein the body includes a hollow open-ended tube, an outer portion with a plurality of vents, a gas deflector, and a pair of male connectors.

Preferably, the body of at least one of the baffles includes an extra rim with a plurality of vents to provide additional strength and further disrupt the flow of gases through the at least one passage.

It is preferred that the first end cap and second end cap are releasably attached to the body of the sound suppressor.

The sound suppressor may further include an expansion chamber adjacent to the first end cap.

Preferably, the apertures in the baffles adjacent the first end cap have a diameter just greater than the diameter of the bullet, and at a predetermined position, the apertures in the baffles are of increasing diameter towards the second end cap, so arranged to encourage the expansion of the gases following the passage of the bullet.

BRIEF DESCRIPTION OF THE DRAWINGS

To enable the invention to be fully understood, preferred embodiments will now be described with reference to the accompanying drawings, wherein:

FIG. 2A shows a schematic side view of the sound suppressor shown in FIG. 1;

FIG. 2B, FIG. 2C and FIG. 2D show alternative components of the sound suppressor shown in FIG. 2A;

DETAILED DESCRIPTION OF THE INVENTION

Figure 1:
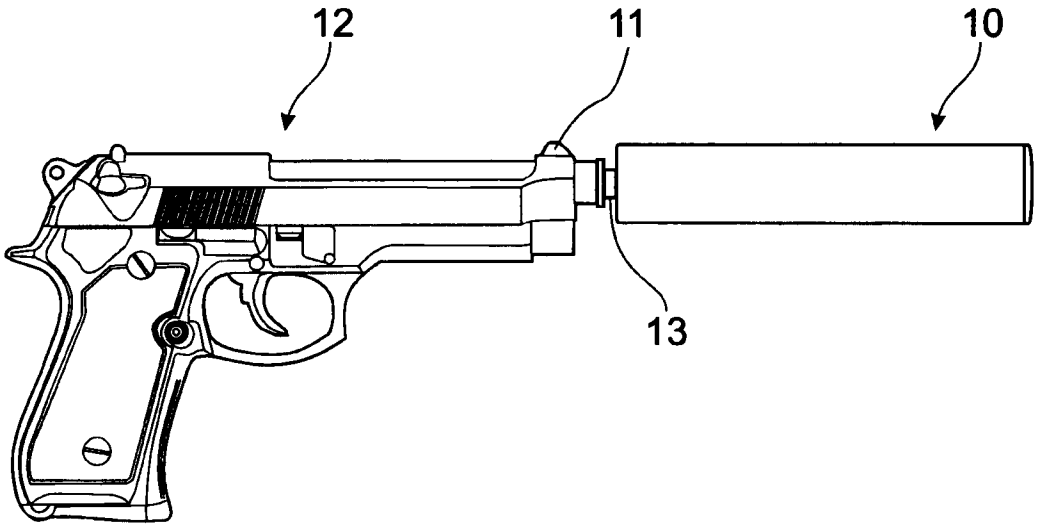
FIG. 1 shows a sound suppressor according to the present invention attached to a firearm.

Referring initially to FIG. 1 there is shown a sound suppressor 10 removably attached to the muzzle 11 of a firearm 12. In this example, the suppressor 10 is attached to the muzzle 11 of the firearm 12 by bayonet couplings 13.

FIG. 2A shows a longitudinal cross section of the sound suppressor 10 of FIG. 1. In this example, the components of the suppressor 10 are enclosed in a body 20 which is substantially cylindrical in shape; however persons skilled in the field will appreciate that the body 20 may be of other suitable shapes including square, pentagon, hexagon, or octagon. The suppressor 10 is closed at either end by first and second end caps 211, 212, 22; and contains apertures for the passage of a bullet 23. The first end cap 21 has an attachment mechanism 24 for releasably mounting the suppressor 10 to the firearm. The first end cap 211, 212 may take different forms as further described in FIG. 3A and FIG. 3B. A plurality of baffles 251, 252, 253 are placed within the body 20 between the first and second end caps 211, 212, 22, and are described in more detail below. The suppressor 10 may also contain a deflecting baffle 261, 262, 263 adjacent to the first end cap 211, 212 to direct the outward expansion of the gases in a forward direction. As illustrated in FIG. 2A, an expansion chamber 27 may be formed between the first end cap 211, 212 and the deflecting baffle 261, 262, 263. As shown in FIG. 2B, FIG. 2C and FIG. 2D, the expansion chamber 27 (located adjacent to the first end cap 211) and the deflecting baffle 263 may take different forms.

Figure 3B:
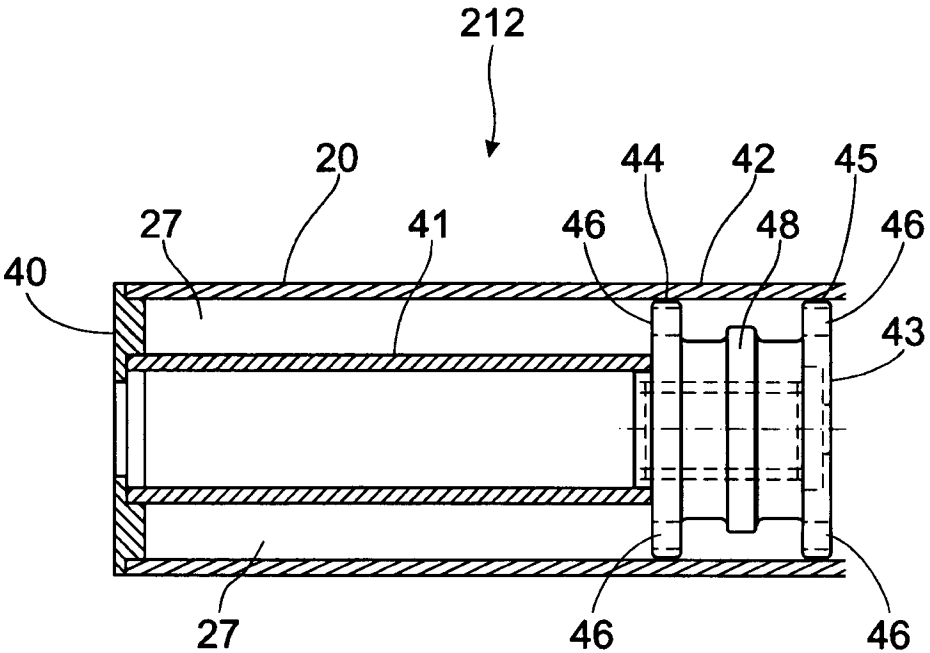
FIG. 3B shows a side view of an alternative arrangement of the first end cap shown in FIG. 3A.
Figure 3A:
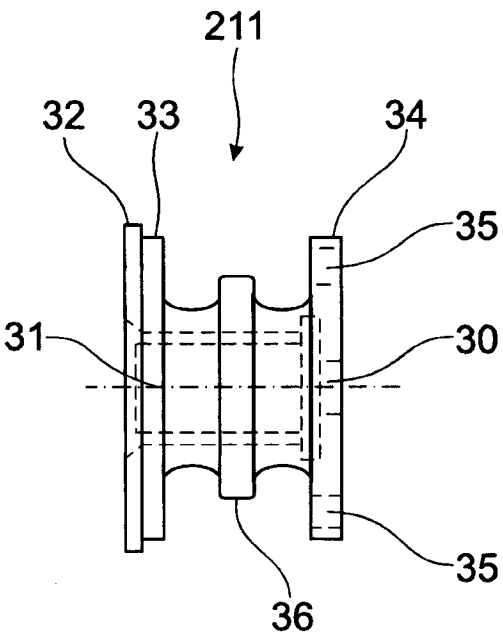
FIG. 3A shows a side view of the first end cap.

The first end cap 211 shown in FIG. 3A has an aperture 30 for the passage of a bullet and a screw threaded bore 31 which is arranged to be coupled to complimentary screw threads on the muzzle of a firearm. The outer edges of the first end cap 211 are defined by annular rims 32, 33, 34 wherein the distal rim 34 contains vents 35 to decrease the weight of the suppressor 10 and increase the volume of the expansion chamber (not shown) formed between the first end cap 211 and the first baffle (not shown). In this example, the first end cap 211 also contains an additional annular rim 36 for increased strength.

FIG. 3B illustrates an alternative version of the first end cap 212 which is especially useful for larger capacity cartridges or longer firearms. In this example, the body 20 extends rearwardly from the first end cap over a portion of the barrel of the firearm (not shown), and is closed off by an outer rim 40. A hollow cylindrical tube 41 is placed inside the body 20 to fit over the barrel of the firearm (not shown), where the length of the tube 41 may be varied to suit the particular firearm used. The distal end 42 of the first end cap 212 comprises a screw threaded bore 43 for releasable attachment to the muzzle of the firearm (not shown), and annular rims 44, 45 with vents 46 to decrease the weight of the suppressor 10 and increase the volume of the expansion chamber 27. In accordance with the previous example, the bore has additional annular rim 48 for increased strength.

Figure 4B:
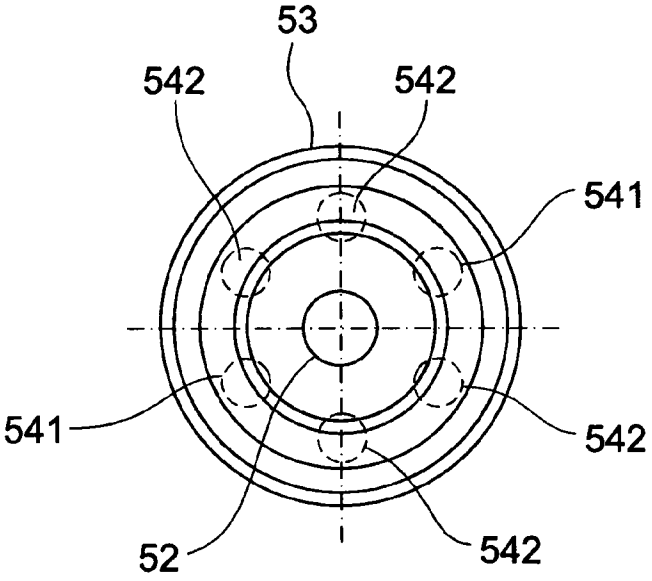
FIG. 4B shows an end view of the second end cap shown in FIG. 4A.
Figure 4A:
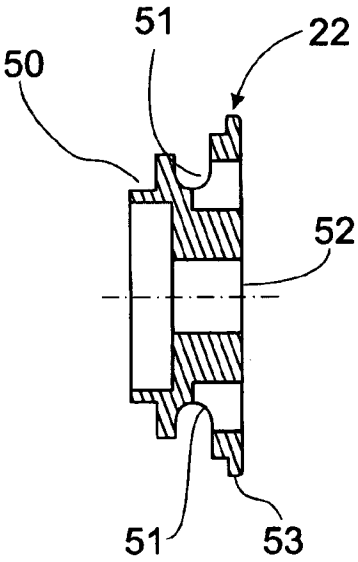
FIG. 4A shows a side view of the second end cap.

FIG. 4A provides a side sectional view of the second end cap 22 which closes the distal end of the sound suppressor. The second end cap 22 is connected to the outer portion of the adjacent baffle (not shown) by means of a male connector 50 and comprises inwardly extending channels 51 to allow the entrance of gases from the body. The second end cap 22 comprises an aperture 52 for the passage of a bullet and an outer portion 53 with at least two diametrically opposed exhaust vents 541 for the release of gases into the atmosphere. As shown in FIG. 4B, the outer portion 53 may have more than two exhaust vents 542.

It would be readily apparent to persons skilled in the field that at least one of the first or second end caps 211, 212, 22 may be releasably affixed to the body 20, for example by a screw thread, to enable their removal for cleaning and/or replacing the baffles 251, 252, 253, 261, 262, 263.

Figure 5B:
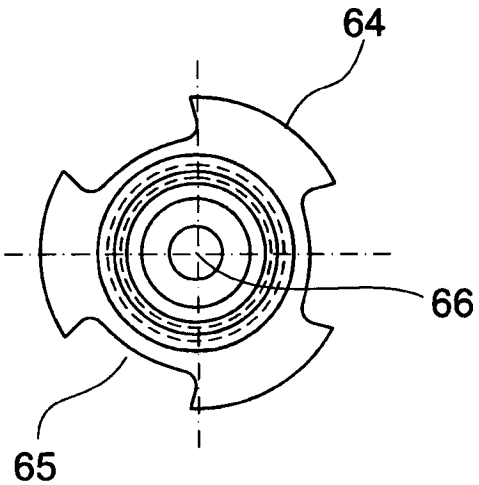
FIG. 5B shows an end view of the outer portion of the baffle shown in FIG. 5A.
Figure 5A:
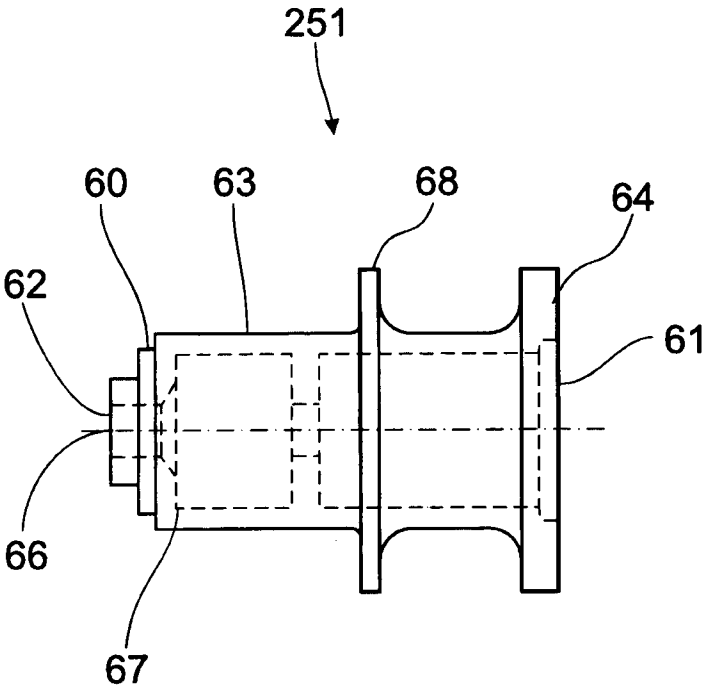
FIG. 5A shows a side view of a baffle.

A side view of a baffle 251 is provided in FIG. 5A, wherein the outer edges of each baffle have male 60 and female 61 connectors for engagement with adjacent baffles (not shown). Each baffle 251 also has a propellant gas deflector 62 on the leading edge, and a flat-topped hollow crown 63 which acts as a spacer. Located adjacent to the crown 63, there is an outer portion 64 which, as shown in FIG. 5B, comprises a plurality of vents 65 wherein the vents 65 in each adjacent baffle 251 are angularly offset to generate at least one tortuous path for the gases. The diameter of the outer portion 64 in each baffle 251 is substantially similar to the diameter of the body 20, thereby directing the gases through the tortuous passages defined by the vents 65. Each baffle 251 also contains an aperture 66 for the passage of a bullet, where the diameter of the aperture 66 increases at a predetermined point 67 to encourage the expansion of gases in this passage.

In an alternative embodiment, each baffle 251 may have an additional outer portion or rim 68 with a plurality of vents (not shown) to further slow the release of the gases and to provide additional strength.

Figure 6A:
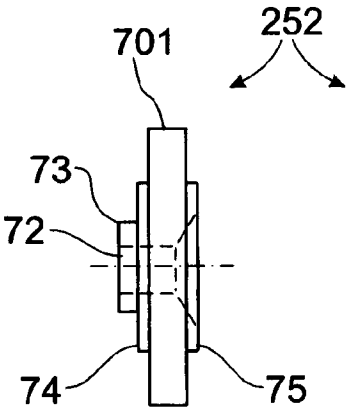
FIG. 6A and FIG. 6B show respective side views of an alternative embodiment of the baffle shown in FIG. 5A.
Figure 6B:
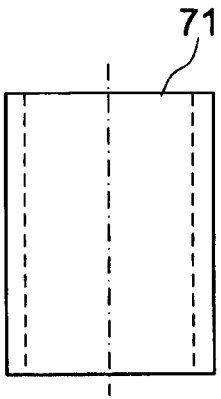
Figure 6C:
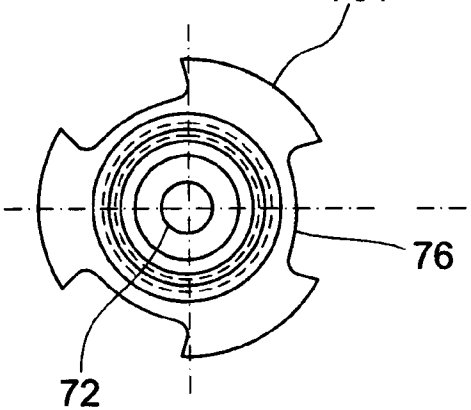
FIG. 6C and FIG. 6D show respective end views of the outer portion and crown of the baffle shown in FIG. 6A and FIG. 6B.
Figure 6D:
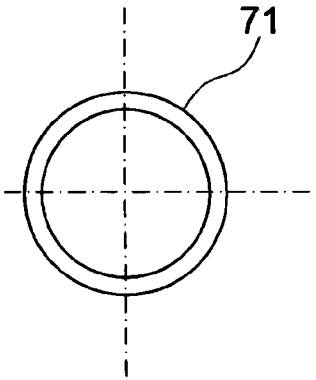

FIG. 6A and FIG. 6B illustrate respective side views of an alternative version of a baffle 252 wherein the outer portion 701 and the crown 71 are manufactured as separate pieces. In this example, the outer portion 701 comprises an aperture 72 for the passage of a bullet, a propellant gas deflector 73 and a male connector 74, 75 on either side for engagement with the crown 71, deflecting baffle 261, 262, 263 and/or second end cap 22. As shown in FIG. 6C, sections of the outer portion 701 are cut-out to provide vents 76 for the passage of gases. The vents 76 in each adjacent baffle 252 are angularly offset to generate at least one tortuous passage for the gases. FIG. 6D illustrates the crown 71, being an open-ended hollow tube that acts as a spacer between the subsequent baffles 252, where the length of crown 71 may be varied to suit the particular firearm used.

Figure 6E:
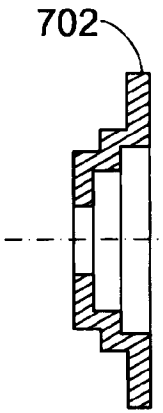
FIG. 6E and FIG. 6F show respective side and end views of another alternative embodiment of the baffle shown in FIG. 5A.
Figure 6F:
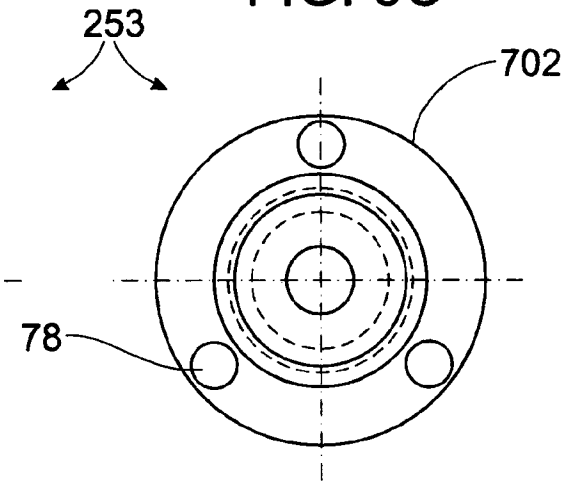

In another embodiment, the baffle 253 may be manufactured from sheet metal which has been punched out and formed into the shape shown in FIG. 6E and FIG. 6F. In this example, the outer portion 702 is substantially circular with a plurality of vents 78 for the passage of gases.

Figure 7C:
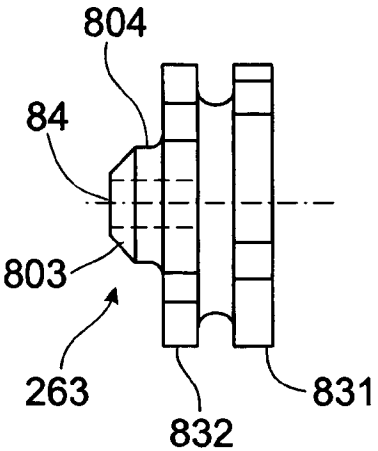
FIG. 7B and FIG. 7C show respective side views of alternative embodiments of the deflecting baffle shown in FIG. 7A.
Figure 7B:
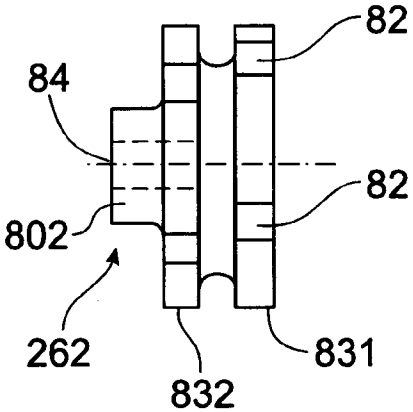
Figure 7A:
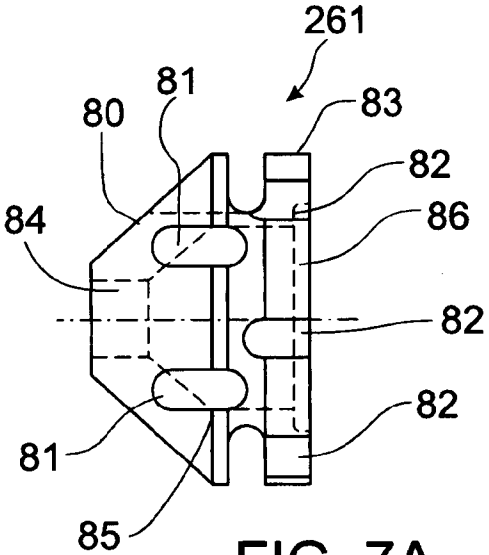
FIG. 7A shows a side view of the optional deflecting baffle.

FIG. 7A shows a side view of the optional deflecting baffle 261. The deflecting baffle 261 has a truncated conical shape 80 to direct the gases in a forward direction along longitudinal troughs 81 on the outer surface, and a number of vents 82 in the outer portion 83 to allow gases to enter the body. Whilst the majority of gases are deflected towards the body 20, some gases inevitably follow the passage of the bullet. Accordingly, the aperture 84 for the passage of the bullet expands mid way down 85 the deflecting baffle 26 to encourage gas expansion. The edge of the outer portion 83 of the deflecting baffle 26 adjoins the body 20 such that an expansion chamber is formed between the first end cap 211, 212 and the deflecting baffle 261. The distance between the first end cap 211, 212 and the deflecting baffle 261, and thus the volume of the expansion chamber, may be varied to suit the particular firearm used. Finally, the deflecting baffle 261 also comprises a female connector 86 for attachment to an adjacent baffle.

FIG. 7B and FIG. 7C show alternative embodiments of the deflecting baffle 262, 263 each having an additional outer portion or rim 832 with a plurality of vents 82 to further slow the release of the gases and provide extra strength. As illustrated, the end of the deflecting baffle 262 which is adjacent to the first end cap 21 may be substantially annular (in end view) 802 with a diameter that is approximately twice that of the bullet. In another example, the deflecting baffle 263 has an intermediate portion that is a truncated cone shape 803 with a concave profile 804 that adjoins the additional rim 832.

Figure 7D:
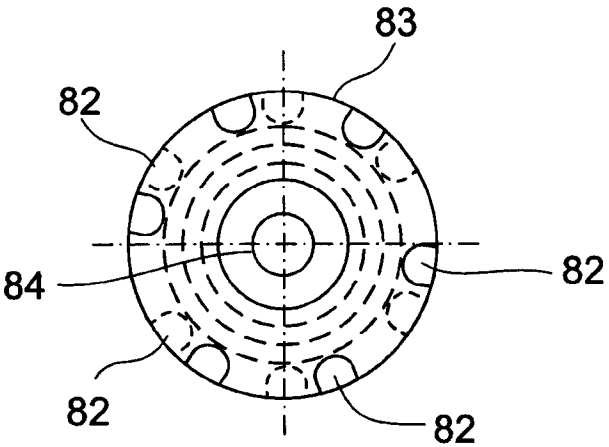
FIG. 7D shows an end view of the optional deflecting baffles shown FIG. 7B and FIG. 7C.

As shown in FIG. 7D, the outer portion 83 has a plurality of vents 82 for the passage of gases.

Figure 8B:
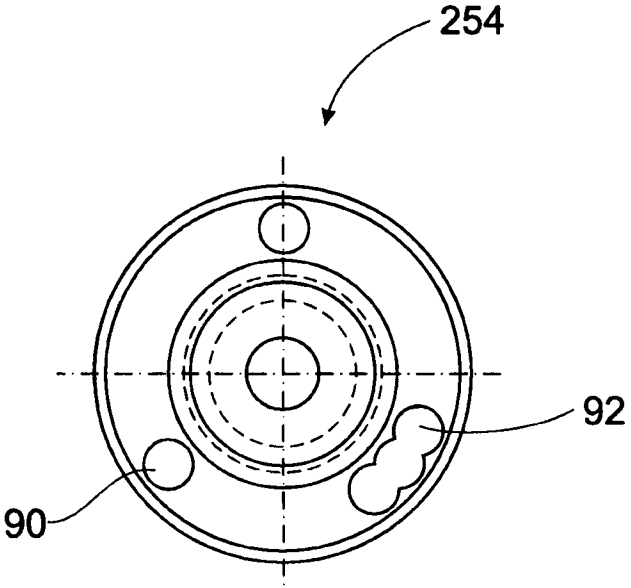
FIG. 8A and FIG. 8B show respective a side and end views of an alternative embodiment of a baffle.
Figure 8A:
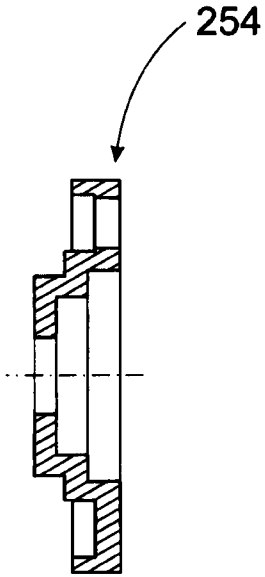

FIG. 8A and FIG. 8B show a side view and an end view of an alternative embodiment of a baffle 254. In this embodiment, one or more vents 90 can be substituted by an elongated slot 92 which is formed by three intersecting holes.

Figure 9:
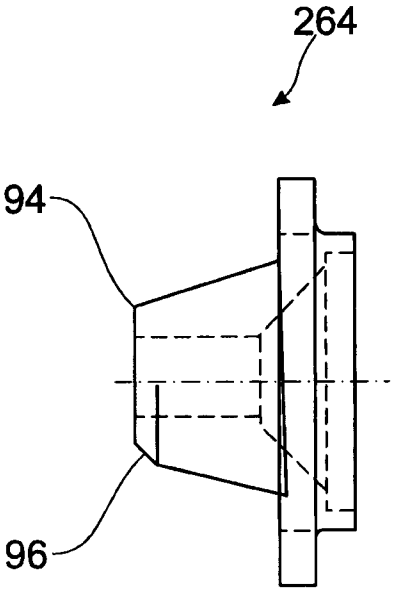
FIG. 9 shows an alternative embodiment of the deflecting baffle.

FIG. 9 shows yet another alternative embodiment of the deflecting baffle 264. As illustrated, the end of the deflecting baffle 264 which is adjacent the first end cap can have a squared edge 94 to suit larger bore firearms, or a beveled edge 96 to suit smaller bore firearms.

Figure 10:
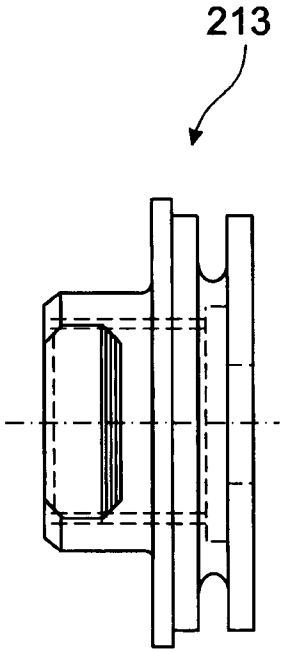
FIG. 10 shows an alternative version of the first end cap.

FIG. 10 shows an alternative version of the first end cap 213. In this example, the first end cap 213, and therefore the sound suppressor, can be mounted to the firearm with the use of a spanner.

Figure 11B:
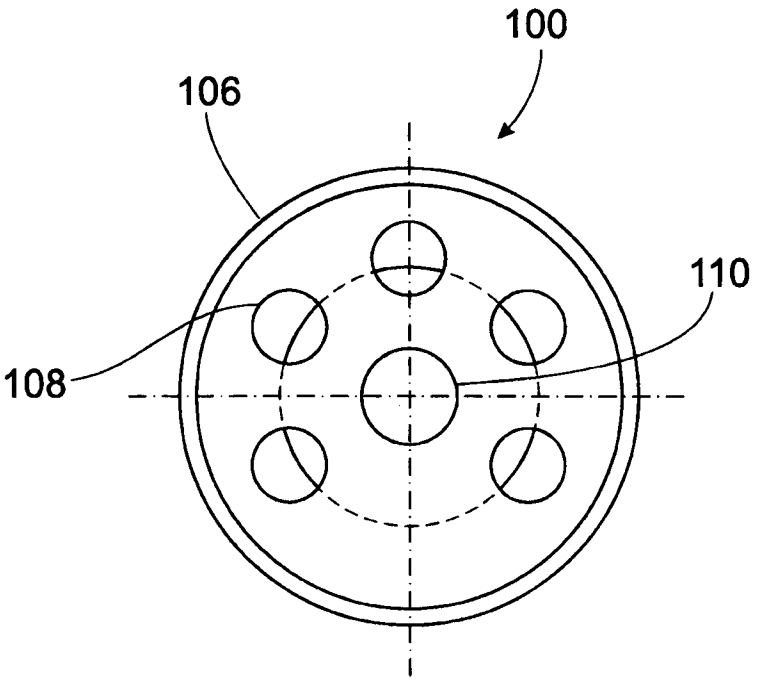
FIG. 11A and FIG. 11B show an optional flash eliminator for the sound suppressor.
Figure 11A:
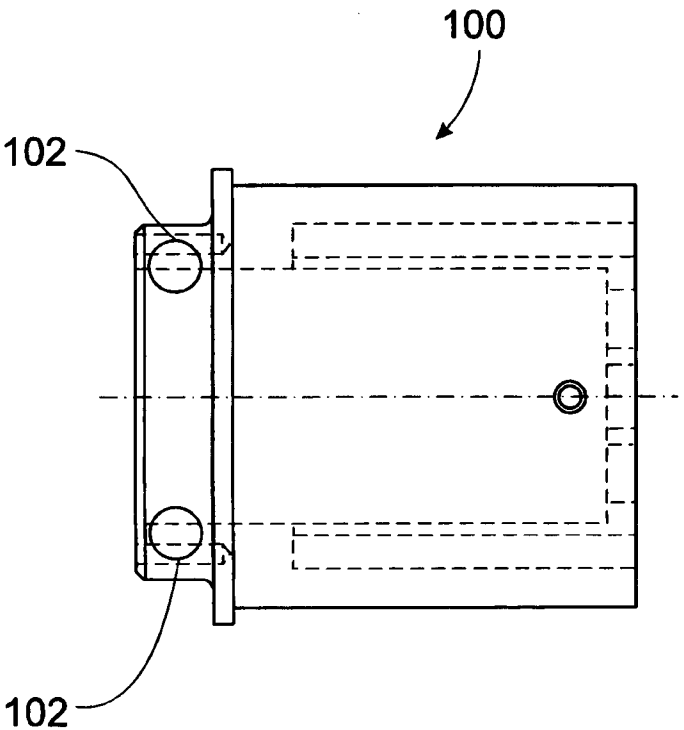

FIG. 11A and FIG. 11B show a flash eliminator 100 which can be attached to the second end cap of the sound suppressor. In this example, the attachment mechanism includes an o-ring assembly 102 which, upon frictional contact with the sound suppressor, is compressed to allow the sound suppressor to fit into the flash eliminator 100. This arrangement is particularly useful as it allows for quick attachment and detachment of the flash eliminator. As illustrated in FIG. 11B, the outer portion 106 of the flash eliminator 100 includes vents 108 for the release of the gases, and an aperture 110 for the passage of a bullet.

In operational use, a bullet fired from the firearm 12 passes out of the muzzle 11, thorough, the passage 23 in the suppressor 10, and exits via the second end cap 22. The pressure from the muzzle 11 of the firearm 12 forces a major portion of the gases to enter the expansion chamber 27 provided between the first end cap 21 and the deflecting baffle 26, while a minor portion of the gases pass through the apertures in the baffles, thereby following the passage of the bullet. The truncated conical shape 80 of the deflecting baffle 26 direct the outward expansion of the gases in a forward direction, where they are released to the body 10 via vents 82 in the outer portion of the deflecting baffle 26. From the deflecting baffle 26, the gases continue to expand as they move through the tortuous paths defined by a plurality of baffles 251, 252 until they reach the second end cap 22. Here, the gases pass through vents 54 in the outer portion 53 of the second end cap 22 and are released into the atmosphere at a greatly reduced pressure and velocity, resulting in increased sound reduction.

The preferred embodiments describe a sound suppressor having the following advantages over the prior art:

- A major portion of the propellant gases are directed away from the passage of the bullet and outwardly towards the body, where the gases are expand and move along at least one tortuous path defined by the vents in the baffles, before exiting the suppressor through the exhaust vents in the second end cap;
- Once the propellant gases are directed outwardly towards the body, they cannot re-enter the passage for the bullet; and The apertures in the baffles adjacent the first end cap have a diameter just greater than the diameter of the bullet, and at a predetermined position, the apertures in the baffles are of increasing diameter towards the second end cap. This encourages the minor portion of the gases following the passage of the bullet to expand.

Various changes and modifications may be made to the embodiments described and illustrated without departing from the present invention.

The invention claimed is:

1. A sound suppressor for a firearm, the sound suppressor comprising:

a body;

a first end cap in the body having an aperture for passage of a bullet and an attachment mechanism for releasably mounting the suppressor to the firearm;

a second end cap in the body, distal to the first end cap, having an aperture for passage of the bullet, a plurality of ports in an inner portion and open to the body for entrance of gases, and a plurality of exhaust vents in an outer portion connected to the ports to allow gases to be released from the suppressor; and a plurality of baffles in the body, between the first end cap and the second end cap, the baffles each having an aperture cooperating to define a passage for the bullet and a plurality of vents in an outer portion, the vents of adjacent baffles forming at least one passage for the gases, the vents of adjacent baffles angularly offset such that the at least one passage for the gases is a tortuous passage, wherein a major portion of the gases pass through the at least one passage from the first end cap to the second end cap, while a minor portion of the gases pass through the apertures in the baffles, the at least one passage being separate and distinct from apertures in the baffles.

2. The sound suppressor of claim 1, wherein:

the attachment mechanism is a thread for screw-attachment, or is a bayonet coupling, for releasable connection between the suppressor and the firearm.

3. The sound suppressor of claim 1, wherein:

the body extends rearwardly from the first end cap over a portion of a barrel of a firearm.

4. The sound suppressor of claim 1, further including:

an expansion chamber adjacent to the first end cap.

5. The sound suppressor of claim 1, wherein:

the first end cap and second end cap are releasably attached to the body.

6. The sound suppressor of claim 1, further including:

a deflecting baffle adjacent to the first end cap, the deflecting baffle having an aperture for the passage of the bullet, and a plurality of vents in an outer rim to re-direct the majority of the gases outwardly towards the body along a separate co-axial and tortuous path to that of the bullet for a complete length of the sound suppressor.

7. The sound suppressor of claim 6, wherein;

the deflecting baffle is of a substantially truncated conical shape to direct outward expansion of the gases in a forward direction;

is substantially annular; or has an intermediate portion which is a truncated cone shape with a concave profile.

8. The sound suppressor of claim 1, wherein:

at least one of the baffles has a single piece body incorporating a gas deflector, a crown, an outer portion with a plurality of the vents, and respective male and female connectors at the ends.

9. The sound suppressor of claim 1, wherein:

at least one of the baffles has a body manufactured from separate pieces; and the body includes a hollow open-ended tube, an outer portion with a plurality of the vents, a gas deflector, and a pair of male connectors.

10. The sound suppressor of claim 8, wherein:

the body of at least one of the baffles includes an extra rim with a plurality of the vents to provide additional strength and further disrupt flow of gases through the at least one passage.

11. The sound suppressor of claim 1, wherein:

the apertures in the baffles adjacent the first end cap have a diameter just greater than the diameter of the bullet; and at a predetermined position, the apertures in the baffles are of increasing diameter towards the second end cap;

so arranged to encourage expansion of the gases following the passage of the bullet.

12. The sound suppressor of claim 9, wherein:

the body of at least one of the baffles includes an extra rim with a plurality of the vents to provide additional strength and further disrupt flow of gases through the at least one passage.

13. The sound suppressor of claim 1, wherein the major portion of the gases are directed away from passage for the bullet and are thereafter prevented from re-entering the passage for the bullet.

14. The sound suppressor of claim 1, wherein a tortuous path is radially between the body and the passage for the bullet and axially between the first and second end caps, the major portion of the gases being directed to an expansion chamber.

15. The sound suppressor of claim 1, wherein a first baffle of the plurality of baffles has a truncated conical shape for directing an outward expansion of the major portion of the gases toward the tortuous passage.

16. The sound suppressor of claim 1, wherein the apertures in the baffles increase in diameter in a direction from the first end cap to the second end cap.

17. A sound suppressor for a firearm, the sound suppressor comprising:

a cylindrical body;

a first end cap in a proximal end of the body having a proximal aperture for passage of a bullet and an attachment mechanism for releasably mounting the suppressor to the firearm;

a second end cap in a distal end of the body, having a distal aperture for passage of the bullet, a plurality of ports in an inner portion and open to the body for entrance of gases, and a plurality of exhaust vents in an outer portion connected to the ports to allow the gases to be released from the suppressor; and a plurality of baffles in the body axially between the first end cap and the second end cap, each baffle of the plurality of baffles having a baffle aperture, the baffle apertures cooperating to define the bullet passage for the bullet, each baffle of the plurality of baffles further having a plurality of vents radially disposed relative to bullet passage, the vents of adjacent baffles forming at least one passage for the gases, the vents of the adjacent baffles angularly offset such that the at least one passage for the gases is a tortuous passage, wherein a major portion of the gases pass through the at least one passage from the first end cap to the second end cap and a minor portion of the gases pass through the apertures in the baffles, and wherein the tortuous passage is separate and distinct from the bullet passage.

18. The sound suppressor of claim 17, wherein a first baffle of the plurality of baffles has a truncated conical shape for directing an outward expansion of the major portion of the gases toward the tortuous passage.

19. The sound suppressor of claim 18, wherein the apertures in the baffles increase in diameter in a direction from the first end cap to the second end cap.

20. The sound suppressor of claim 17, wherein the major portion of the gases are directed away from passage for the bullet and are thereafter prevented from re-entering the passage for the bullet.

* * * * *